US006294072B1

(12) United States Patent
Fairbourn

(10) Patent No.: US 6,294,072 B1
(45) Date of Patent: Sep. 25, 2001

(54) REMOVAL OF METAL OXIDE SCALE FROM METAL PRODUCTS

(75) Inventor: David C. Fairbourn, Sandy, UT (US)

(73) Assignee: Aeromet Technologies, Inc., Sandy, UT (US)

( * ) Notice: Subject to any disclaimer, the term of this patent is extended or adjusted under 35 U.S.C. 154(b) by 0 days.

(21) Appl. No.: 09/398,859

(22) Filed: Sep. 20, 1999

(51) Int. Cl.[7] ..... C25F 5/00
(52) U.S. Cl. ..... 205/706; 205/717; 204/248
(58) Field of Search ..... 204/248; 205/657, 205/706, 717

(56) References Cited

U.S. PATENT DOCUMENTS 3,649,491 * 3/1972 Bowers et al. ..... 204/146
3,984,295 * 10/1976 Kametani et al. ..... 204/107
4,406,761 * 9/1983 Shimogori et al. ..... 204/144.5
4,544,462 * 10/1985 Furutani et al. ..... 204/129
4,588,488 5/1986 Sumita et al. .

OTHER PUBLICATIONS

United States Steel, Association of Iron and Steel Engineers, The Making, Shaping and Treating of Steel, pp 1084–1095, 1985, Pittsburgh, Penn.

* cited by examiner

*Primary Examiner*—Arun S. Phasge
(74) *Attorney, Agent, or Firm*—Wood, Herron & Evans, LLP

(57) ABSTRACT

A system and process is provided for stripping metal oxide scale from metal products, such as stripping iron oxide scale from steel sheet and steel mill products. Steel having iron oxide scale compiling a layer of one or more iron oxide phases is associated with an electrolyte, such as by being immersed in a tank filled with the electrolyte, such as a dilute acid mixture. A counter electrode having a higher potential than steel is also associated with the electrolyte. The counter electrode is dc coupled to the steel, or to a conductive component in direct contact with the steel, such that electric current flows from the steel to the counter electrode due to the difference in the natural potentials of steel and the counter electrode. The metal oxide scale is thereby stripped from the steel.

34 Claims, 4 Drawing Sheets

REMOVAL OF METAL OXIDE SCALE FROM METAL PRODUCTS

BACKGROUND OF THE INVENTION

The present invention relates to removal of metal oxide scale which forms on metal products, and more particularly to a pickling method for stripping such scale from processed metal products, such as steel.

Rolled, forged and heat treated metal products are formed by hot processes into many different shapes, such as flat sheet and bar. Metal products may be further processed by annealing, pickling, and cold rolling. With respect to steel products, cold rolling produces a finished steel material that has a smoother finish and more accurate dimensions than a non-cold rolled product, and furthermore, hardens the steel material to provide a stronger product. These finished materials are then sold to fabricators for manufacture into a wide variety of products. For example, sheet steel is sold to automobile manufacturers for use in automobile bodies.

With respect to the manufacture of steel sheet, in large integrated steel mills, steel slabs are rolled into sheet of about 0.05–0.25 inch thickness and then rolled into coils weighing up to about 20–40 tons. The slabs are rolled in the red-hot condition. The coiled sheet is referred to as a hot band. After coiling, the hot band is allowed to cool before it is processed for use in finished product. Steel bars and other shapes may also be manufactured using any of various hot processes and then allowed to cool before subsequent processing. In any case, during the manufacturing process, layers of material collectively referred to as mill scale may form over the surface of the steel.

One particular aspect of the mill scale is a layer of metal oxide scale that typically forms as the hot band cools. The metal oxide scale that forms on the steel results from a chemical oxidation reaction and typically comprises three phases of iron oxide, namely, FeO, $Fe_2O_3$ and $Fe_3O_4$. The thickness of that iron oxide scale and the relative amounts of the iron oxide phases will vary with temperature, grade of steel and cooling rates, for example.

The iron oxide scale layer present on the steel is known to interfere with subsequent processing and use of the steel. With sheet steel, for example, the scale layer may abrade adjacent portions of steel in the coil thereby ruining the steel surface for subsequent use. Similarly, the scale can adversely affect the equipment used to process the steel. It may even be impossible to use steel for further processes such as cold forming if the product quality is poor due to the metal oxide scale layer.

Thus, prior to subsequent processing, it has been known to expose the steel to a pickling process in which the metal oxide layer is chemically removed from the metal surface by action of water solutions of inorganic acids. In one such process used for sheet steel, the hot band is uncoiled, and the sheet steel passed through a series of acid tanks and rinsing tanks in a continuous or semi-continuous pickling line. As the sheet passes through the acid tanks, the acid solution, which is typically subjected to agitation, removes the oxide scale from the surface of the sheet steel. For bar stock and other shapes, bundles referred to as lifts are pickled in a batch process, i.e., the lift is immersed in an acid tank and held therein while the acid solution is agitated such as by stirring, until the scale layer is removed. In some cases, it may be necessary to mechanically disrupt the scale layer in order for the acid solution to effectively remove the scale. For this purpose, scale breakers may be employed. Prior to pickling sheet steel, for example, the sheet is passed through a pair of rollers which reduce the thickness of the scale layer and open up the scale surface for attack by the acid in the tank.

When stainless steel is hot processed, a metal oxide scale forms on the surface, similar to the iron oxide formation on low carbon steel. To make the final stainless steel product shiny in appearance, flat, and to prevent damage to subsequent processing equipment, the stainless steel products also are pickled using the same or a similar acid pickling process to those described above. Additionally, products that are to be galvanized or electro-galvanized, a process whereby a zinc coating is deposited onto the steel to form a protective layer, also are first pickled to remove surface oxide layers to expose the steel for the zinc coating.

In addition to steel products, other metal products develop metal oxide scale as a result of hot processing. By way of example and not limitation, aluminum, zirconium, zinc, copper, alloys thereof and other metals and alloys also form oxide scales during manufacturing that must be removed by a pickling process.

Such pickling processes, while widely used to remove metal oxide scale, have many limitations and drawbacks. One particular concern with the pickling process is the throughput rate, i.e., the amount of metal that can be pickled in a set amount of time. The throughput rate is limited in that the steel or other metal must be exposed to the acid solution long enough to fully clean the metal surface of the scale layer. The time necessary to accomplish full pickling is affected by numerous variables, including solution temperature and concentration, agitation and time of immersion.

In an effort to minimize the time necessary to effect complete scale removal, the steel industry routinely employs hot sulfuric or hot hydrochloric acid for the pickling process. These acids are highly caustic, and are heated to temperatures at or above 140° F. (60° C.) for batch pickling processes, and between about 200° F. and 220° F. (93° C. and 104° C.) for the continuous and semi-continuous pickling processes. Such caustic acids, especially at high temperatures, present significant environmental and safety hazards.

Some attempts that have been made to improve the pickling process have centered on methods of arranging nozzles, spray pressures and segmentation of acid into zones to reduce drag-out from one tank to the next. These methods, however, continue to rely on high acid concentrations and temperatures.

Sumita et al. U.S. Pat. No. 4,588,488 proposes to reduce the temperatures and concentrations used in the pickling process for steel with an electron injection method based on cathodic polarization. In this method, a platinum electrode and steel part are immersed in a wash liquid containing an electrolyte, a pH regulating agent and a complexing agent. The positive cathode of an external dc power source is coupled to the electrode, and the negative anode is coupled to the steel. By imposing a positive voltage across the electrode to the steel, the oxide layer is said to be brought into an unstable region by shifting the potentials of the oxides in the base direction from the natural potential to the cathodic polarization potential. At this potential, the oxide is said to be unstable and will dissolve while the metal iron is stable and protected from corrosion. By this method, it is said to be possible to reduce the temperature and acid concentration of the wash bath while still achieving acceptable stripping times.

The method proposed in the Sumita et al. patent is believed to have many deficiencies, and is not readily applicable in the context of a steel mill, for example. On the one hand, the potential that is applied must be regulated and adjusted in accordance with the actual potentials encountered during the process. The nature of the oils that build up in a pickling tank, and the behavior of the materials therein, make it difficult, if not practically impossible, to monitor the various components and properly control the applied potential. Moreover, the electron injection method is not believed to produce any meaningful improvement in pickling process throughput.

There thus remains a need in the metal manufacturing industries, such as in the steel industry, to improve pickling processes for metal oxide scale removal to not only allow for a reduction in acid concentrations and temperatures, but to do so in a simple and realizable manner that does not adversely affect pickling times, but instead may actually speed up the pickling process.

SUMMARY OF THE INVENTION

The present invention provides a chemically based pickling process and system that strips metal oxide scale from metal products, for example, mill scale from steel sheet and mill products, at a faster rate, and yet at a lower cost and with fewer hazards than in the prior pickling processes described above. The system of the present invention takes advantage of the natural E° differential between the metal and the metal oxide, such as that between iron and the iron oxide scale layer in the mill scale, to effect a battery action that strips the metal oxide scale. To this end, and in accordance with the principles of the present invention, a metal product, such as a steel mill product or sheet steel, is dc coupled to a separate counter electrode having a higher potential (E°) than that of the metal surface to be stripped, and the metal and counter electrode are immersed in or otherwise associated with an electrolyte bath without imposition of an external positive voltage from the electrode to the metal. With the dc coupled metal immersed in or otherwise associated with the electrolyte, an electrochemical cell is believed to be created in which the metal oxide scale is dissolved into the stripping bath until the scale is nearly or completely removed. The stripping process occurs in a short amount of time, without the need for an external power source.

In accordance with a further feature of the present invention, the electrolyte bath may be maintained virtually at room temperature, thereby avoiding risks of hightemperature burns and reducing fuming and evaporation of volatile components. Further, the cost of operation is reduced, as the electrolyte need not be heated.

Still further, concentration of the electrolyte may be relatively weak, such as with a dilute concentration of acid or base solution. Consequently, a less hazardous and more environmentally friendly process is achieved, while disposal and handling costs are reduced.

If desired, in accordance with the principles of the present invention, the effect of the natural E° differential may be expanded by connecting an external voltage in the negative sense from the counter electrode to the metal product as opposed to the positive sense of Sumita et al. The negative potential need not be carefully regulated or controlled in relation to the bath or materials, and so is easier to apply and utilize than the positive potential of Sumita et al. and yet is believed to increase the rate of stripping.

By virtue of the foregoing, there is thus provided a system and process for stripping metal oxide scale from metal products which not only allows for a reduction in acid concentrations and temperatures as compared to conventional pickling processes, but does so in a simple and realizable manner that does not adversely affect pickling times, but instead may actually speed up the pickling process. These and other objects and advantages of the present invention shall become more apparent from the accompanying drawings and description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the principles of the invention.

DETAILED DESCRIPTION OF THE DRAWINGS

Figure 1:
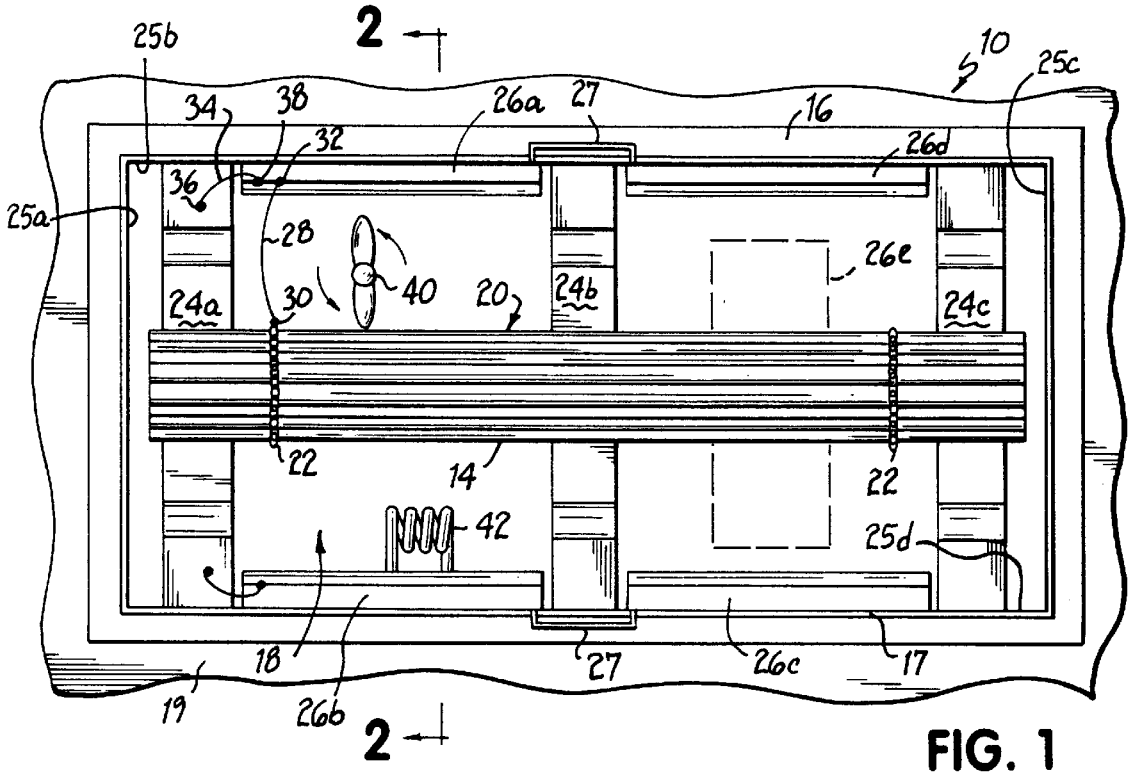
FIG. 1 is a top plan view of a batch-type pickling system for stripping metal oxide scale from a bundle of steel products in accordance with the principles of the present invention.

The present invention provides for the removal of metal oxide scale from metal, such as steel, without the need to overcome the natural potentials of the metal and metal oxides, as in Sumita et al. To this end, and in accordance with the principles of the present invention, the steel to be stripped is immersed in or otherwise associated with an electrolyte and dc coupled to a separate counter electrode exposed to the electrolyte and having an E° greater than the E° of steel without imposition of an external positive voltage from the electrode to the steel. The standard electrode potential E°, expressed in volts, is defined as the potential of an element immersed in a solution of its ions at unit activity. E° may be measured by Electrochemical Impedance Spectroscopy (EIS). An electromotive (driving) force (emf) results from the relative potential forces of the two dissimilar electrodes (the steel products 14 and the counter electrode 26). The greater the magnitude of the differential between the E° values of the counter electrode 26 and the steel products 14, the greater the emf produced, and thus a faster and more effective stripping of the oxide layer 12 may be obtained.

The removal of metal oxide scale is believed to be an electrochemical event. In fact, all aqueous corrosion can be considered electrochemical. In other words, one can usually find two metals, an electrolyte and an electrical path. Chemically, a description of what is believed to occur may be useful. Even if one single monolithic steel bar is immersed in the acid, an electrochemical cell is set up. One side of the cell will be comprised of the steel matrix. Because steel is mainly a very low carbon iron (less than 1 wt.% carbon) along with a few impurities, it is primarily an iron matrix. Directly attached to it is FeO, an unstable oxide of iron. The FeO is considered more noble (higher E°) than the iron. The acid is considered the electrolyte. Although FeO is not a particularly good conductor of electrons, any connection between the iron matrix and the FeO matrix will function as the electrical connector.

A solitary atom of iron of zero valence, defined as Fe°, is not thought to exist in aqueous solution. For metals to be dissolved in solution, they must first be ionized to a valence state, $Fe^{+2}$ or $Fe^{+3}$, then surrounded by ligands, normally supplied by the acid electrolyte or by water, then hydrolyzed or surrounded by water molecules. The water molecules with their partial polar nature (the oxygen side is slightly negative and the hydrogen side is slightly positive) help to completely neutralize the charge in solution. The result is large, loosely held molecules with a single iron atom, ionized, in the center position.

Ionization takes place when either two or three electrons are given up by the iron atom as it goes into solution. In all electrochemical cells, there is an electrical current that follows the Ohm's Law, E=IR. The two sides become polarized as one becomes rich in electrons, thereby attracting the iron iron in solution to the other material, in this case the FeO. Once there, another electron exchange takes place, and reaction by-products are produced.

This explanation becomes far more complicated due to the other two iron oxide phases, $Fe_2O_3$ or $Fe_3O_4$. In this case the $Fe_3O_4$ is more noble than the $Fe_2O_3$ and likewise $Fe_2O_3$ is more noble than FeO. Therefore, small, simultaneous electrochemical cells are also set up for the $Fe_2O_3$—$Fe_3O_4$ couple, the FeO—$Fe_2O_3$ couple, and the Fe—FeO couple.

The pickling of steel is an electrochemical event where the piece of steel itself polarizes to form the function of both anode and cathode. To some, this may seem a theoretical impossibility. Normally, we presume that a monolithic piece of steel is conductive and therefore at the same electrical potential everywhere. Due to the internal resistance of the steel, and the possibility of formation of Nernst Diffusion layers of different concentrations at various positions on the steel, plus several different layers of oxides, it is possible to sustain a small voltage difference.

Given that pickling is an electrochemical event, it is also possible to alter the pickling bath configuration. In the improvement of the present invention, a separate counter electrode of a material different, but more noble, than steel is added to the pickling tank. By direct dc coupling of the steel being immersed to the counter electrode without imposition of an external positive voltage from the electrode to the steel, a larger electromotive force is induced into the steel product than if no such connection is made. The result is that the pickling operation can be made to operate faster while reducing concentration and temperature of the bath.

Figure 2:
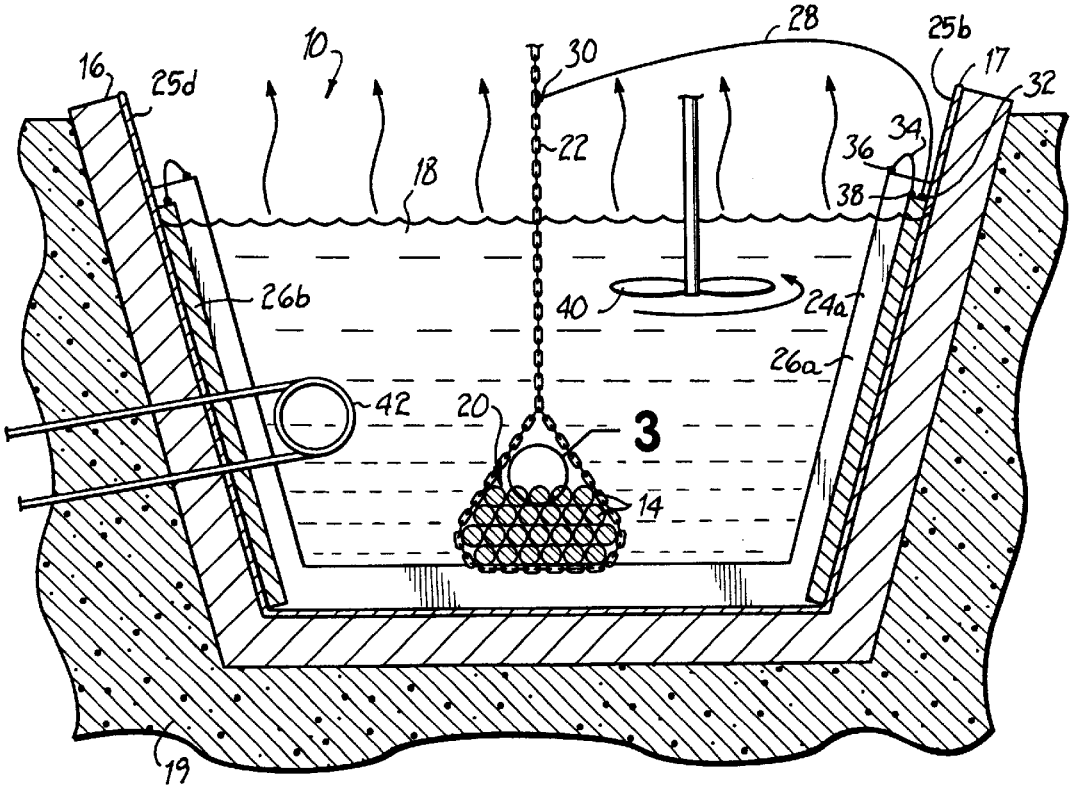
FIG. 2 is a cross-sectional view of the system of FIG. 1 taken along line 2—2.
Figure 3:
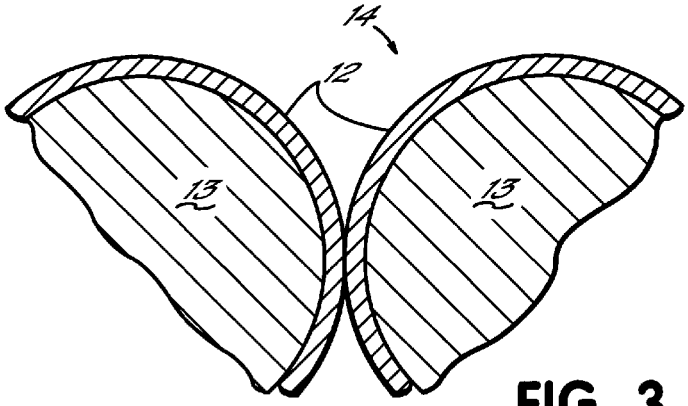
FIG. 3 is an enlarged view in cross-section of Area 3 of steel products in the system of FIG. 2.

With reference to FIGS. 1 and 2, there is shown in plan view and cross-section, respectively, a first embodiment of the present invention, namely a batch-type pickling system 10 for stripping steel products 14, such as steel bars. As seen in the enlarged view of FIG. 3, the steel product 14 has an iron oxide scale layer 12 over the major surface of steel 13, which scale layer 12 is to be removed from surface 13. The mill scale coated steel products 14 are immersed in a tank 16 having an acid resistant liner 17 and filled with an electrolyte 18, such as a dilute acid or base solution in water. Tank 16 may be supplied in the ground, as at 19. A plurality of steel products 14 may be grouped together in a bundle or lift 20 and immersed in the tank 16 by one or more chain slings 22 or other suspension device capable of lowering and raising the bundle 20. The chain sling 22 may be made of high strength material such as HASTELLOY® C-276, a nickel-chromium-molybdenum alloy, or stainless steel 316. The tank may also be provided with one or more bolsters 24 in the bottom of the tank 16 to provide structural support for the extremely heavy steel products (about 5 tons in a bundle) laid to rest upon the bolsters 24. This may prevent structural damage to the bottom of the tank 16. The bolsters 24 are made of a material of sufficient strength to support the large tonnage, such as HASTELLOY® C-276 or other corrosion-resistant materials. As shown in the embodiment of FIGS. 1 and 2, three U-shaped bolsters 24*a*,24*b*,24*c* are placed in the tank to support the ends and the middle of the immersed bundle 20 of steel bars.

One or more counter electrodes 26 having an E° greater than the E° of the steel product 14 is immersed in the electrolyte 18. The counter electrode 26 advantageously has an immersed surface area equal to or exceeding the total surface area of all steel products 14 immersed in the electrolyte 18 to insure that the electrochemical reaction proceeds to completion, but this relationship is not considered essential in the system of the present invention. Given the immense size of the batch-type tanks 16 used for pickling steel products, generally on the order of 24 feet long, by 10 feet wide, by 4 feet deep, the counter electrodes 26 advantageously comprise graphite sheets in the form of slabs or plates lining one or more of the inner walls 25 of the tank 16. In FIG. 1, two counter electrodes 26*a,d* line inner wall 25*b*, and two counter electrodes 26*b,c* line inner wall 25*d*. If more than one counter electrode is needed to provide the desired surface area, the counter electrodes 26*a*,26*b*,26*c*,26*d* need to be conductively connected to each other, but need not form a sealed lining within the tank. Any type of connection 27 (by way of example, clips, solder, screws, rivets, welds, rods, etc.) known to one skilled in the art may be used to conductively dc couple the counter electrodes. Further, additional counter electrodes 26*e* (shown in dotted line) may be provided in the bottom of the tank, such as between the optional bolsters 24*b,c* provided they, too, arc conductively coupled to the other counter electrodes 26*a–d*.

The counter electrode 26 is electrically dc coupled to steel products 14 such as by a wire 28 connected as at 30 and 32 to chain sling 22 and counter electrode 26, respectively, and/or such as by wire 34 connected as at 36 and 38 to bolster 24 and counter electrode 26, respectively. The connection may be by any conductive connection, such as clips, solder, screws, rivets, welds, rods, etc. The chain sling 22 or the bolster 24, if part of the dc circuit, are made from a conductive material more noble (i.e., higher E°) than the steel products 14. Wire 28 and/or wire 34 provides a dc current path between steel products 14 and counter electrode 26. It should be noted that no external power supply is used to impart a positive voltage from the electrode 26 to the steel product 14; and yet, full stripping may be achieved. As discussed previously, it is believed that when the dc coupled items are placed into the tank 16, an electrochemical cell is created having a large electromotive force such that an electrochemical corrosion reaction results, which strips the scale layer 12 from the steel products 14, with the scale 12 dissolving into electrolyte 18. The amperage of the system should be about 0.23 Amps for every 3 to 4 square inches of total immersed steel.

Figure 4:
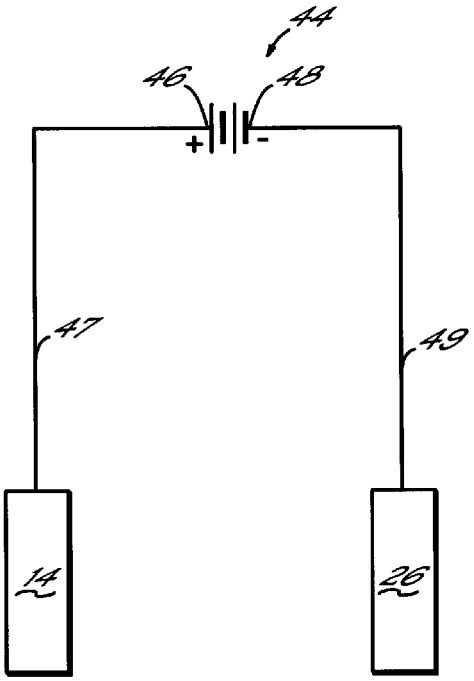
FIG. 4 is a schematic view of an alternative embodiment of a system of the present invention.

If desired, however, an external power source 44 may be placed in the circuit to add an additional electromotive force over the natural one. This additional voltage, which may, for example, be in the range of 1–6 volts, with the positive cathode 46 dc coupled via wire portion 47, or other conductors, to the steel product 14 and the negative anode 48 decoupled via wire portion 49, or other conductors, to the counter electrode 26 is thus added in the negative sense, as shown in FIG. 4, to thus dc couple the counter electrode 26 to the steel product 14 through source 44 while expanding the effect of the E° differential so as to speed up the reaction according to Ohm's Law (E=IR). Whereas Sumita et al., discussed above, imposed a positive voltage from the counter electrode to the steel product to, in effect, overcome the natural potentials of the system, the present invention adds negative voltage from the counter electrode to the steel product to, in effect, enhance the natural potentials of the system. Thus, while an external power source is not essential to achieve stripping of the metal oxide scale from the steel, it may serve to speed up the process if applied in the negative sense to thus increase the efficiency of the pickling process.

A device for agitating or stirring the electrolyte is added to the system to speed up the pickling rate. This device may comprise a stirring mechanism or agitator 40 in the electrolyte bath as shown in FIG. 1, or it may be a pump (not shown) that continuously adds and extracts electrolyte from the tank to thereby agitate the bath.

The electrolyte 18 may effectively strip scale layer 12 from the steel products 14 when maintained at room temperature, and advantageously, electrolyte 18 is a dilute solution of acid or base in water, as will be discussed later. If it is desired that the electrolyte 18 be above room temperature to increase the pickling rate, a heating coil 42 may be provided in the tank 16. Regardless of the type of electrolyte 18, the acid or base concentration, or the temperature of the bath, the use of a counter electrode 26 in accordance with the principles of the present invention lessens the time necessary for stripping a scale layer 12 from a steel product than occurs in conventional pickling processes.

Figure 5:
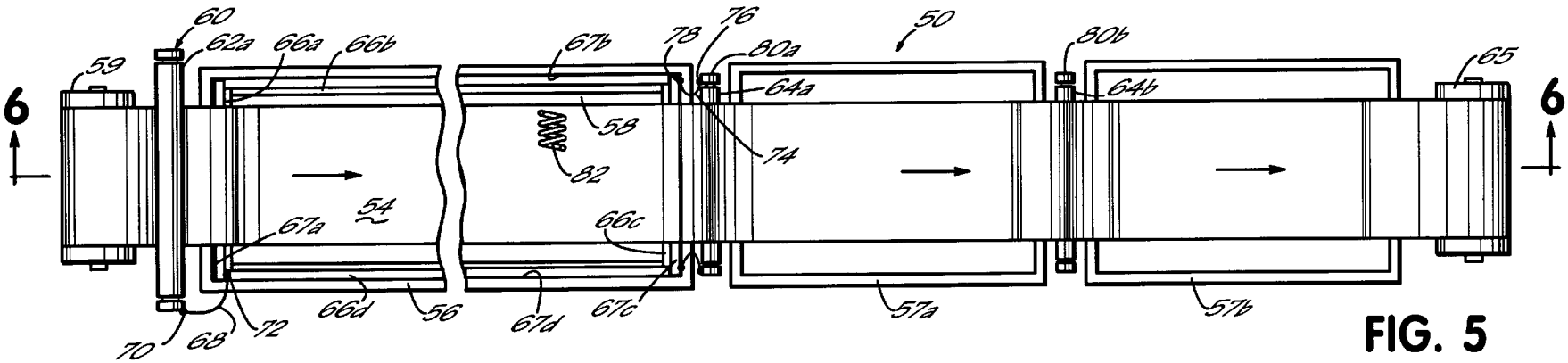
FIG. 5 is a top plan view of a continuous pickling line for stripping metal oxide scale from steel strip in accordance with the principles of the present invention.
Figure 6:
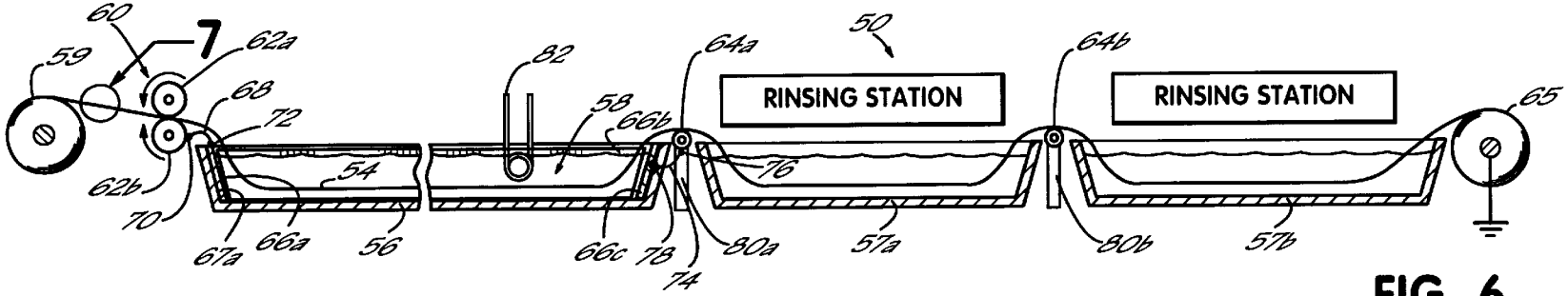
FIG. 6 is a cross-sectional view of the system of FIG. 5.
Figure 8:
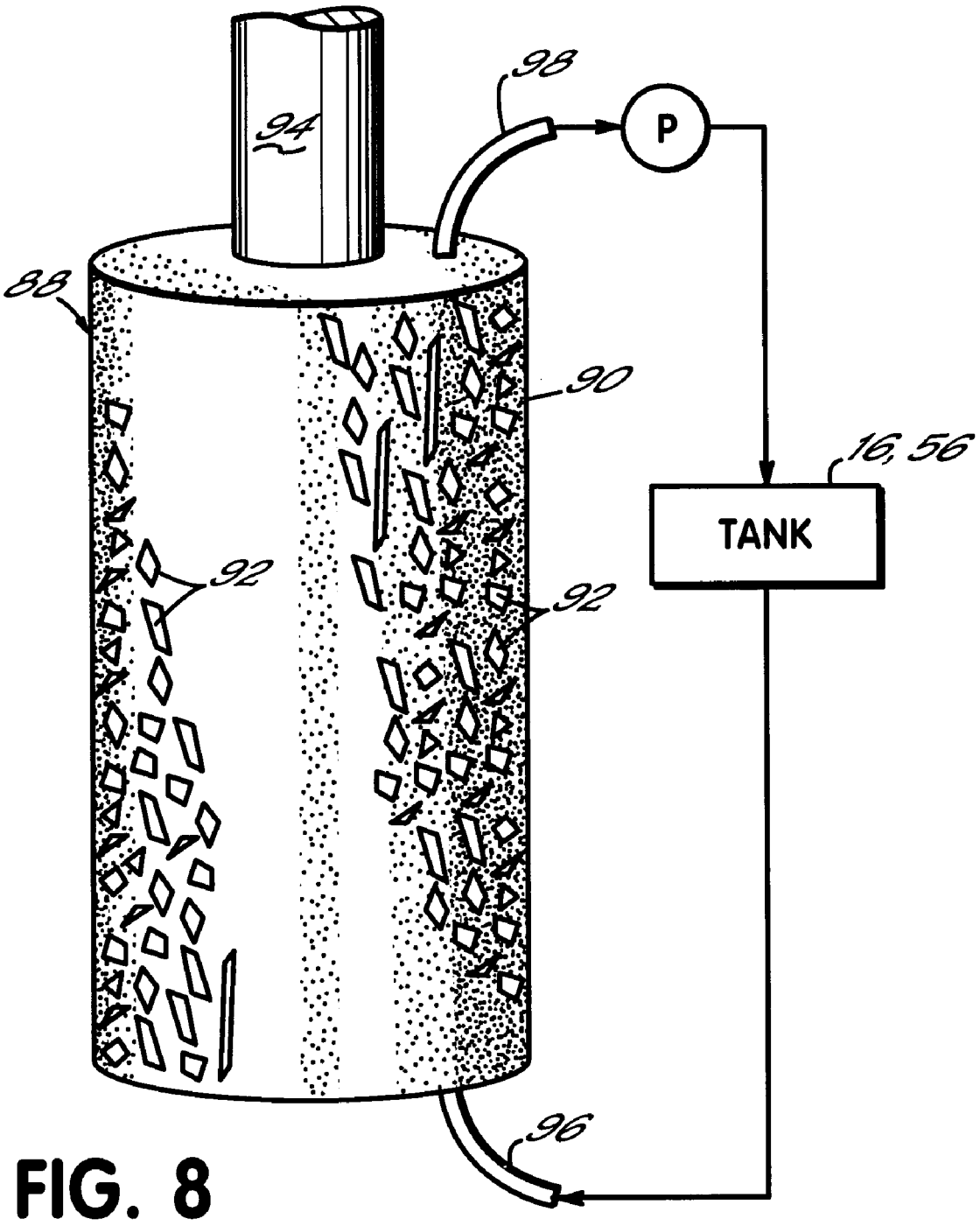
FIG. 8 is a side elevational view of an alternative embodiment of a counter electrode for use in the present invention.

With reference to FIGS. 5 and 6, there is shown a top plan view and cross-sectional view, respectively, of a second embodiment of the present invention, namely a continuous-type pickling system 50 for stripping metal oxide scale layer 52 from a steel sheet 54. As seen in the enlarged view of FIG. 7, the steel sheet 54 has an iron oxide scale layer 52 over the major surface of steel 53, which scale is to be removed from steel 53. The scale coated steel sheet 54 is immersed in a tank 56 filled with an electrolyte 58, such as a dilute acid or base solution in water, followed by immersion in one or more rinsing tanks 57*a*, 57*b* filled with water for rinsing the acid from steel sheet 54. This system 50 is a continuous pickling line similar to those typically used in the industry for removing scale 52 from the steel subsequent to the continuous hot rolling operation in preparation for the cold reduction of the sheet to final thickness. After hot rolling, the steel sheet is typically coiled and prior to pickling, the sheet is uncoiled, such as by uncoiler 59, and passed through a scale breaker 60, which consists of a pair of rollers 62*a*, 62*b*. The rollers flex the steel around the rolls, thus effectively "breaking" the surface scale into numerous fine cracks, which increases the available suboxide area for acid attack in the pickling process. The steel sheet 54 is then fed from the scale breaker 60 into a first acid tank 56 at a continuous or semi-continuous rate for a time sufficient to remove the scale layer 52 from the steel 53. If desired, the electrolyte 58 may be heated to above room temperature to increase the pickling rate, such as by heating coil 82. Furthermore, an agitator (not shown) may be added to the tank 56 to agitate or stir the electrolyte 58 to increase the pickling rate, and acid spraying devices (not shown) may also be used, as known in the art, to spray the acid onto the sheet steel 54. The continuous feeding of the steel sheet may involve passage through a series of acid tanks (not shown) optionally situated with additional scale breakers (not shown) between tanks. The steel sheet 54 is then fed, such as by looping supports 80*a*,80*b* with rollers 64*a*, 64*b* positioned thereon, through one or more rinsing tanks 57*a*,57*b* filled with water to remove the acid from the surface of steel sheet 54, followed by coiling, such as by coiler 65.

The acid tanks 56, and optionally one or more of the rinsing tanks 57*a*,57*b*, further include one or more counter electrodes 66 having an E° greater than the E° of the steel sheet 54. The counter electrodes 66 may advantageously have an immersed surface area equal to or greater than the immersed surface area of the steel sheet 54, although this relationship is not essential in the system of the present invention. Given that the steel sheet 54 is continuously moving through each tank, the surface area referred to is that area in the tank at any given point in time, which is a relatively constant value. In FIG. 5, four counter electrodes 66*a*, 66*b*, 66*c*, 66*d* line inner walls 67*a*, 67*b*, 67*c*, 67*d*, respectively of tank 56. The counter electrodes 66*a*, 66*b*, 66*c*, 66*d* must be dc coupled to each other. Additional counter electrodes (not shown) may be placed in the bottom of the tank, provided they, too, are dc coupled to the other counter electrodes 66*a–d*. The counter electrode 66 is electrically dc coupled to steel sheet 54 such as by a wire 68 connected at 70 and 72 to scale breaker 60 and counter electrode 66*a*, respectively, and/or by wire 74 connected at 76 and 78 to a conductive component, such as looping support 80, which is in contact with the steel sheet 54, through roller 64, and counter electrode 66*c*, respectively. To this end, scale breaker 60 and it's rollers 62*a*, 62*b* and/or support 80 and it's roller 64 are dc conductive. Wire 68 and/or wire 74 and the conductive scale breaker 60 and/or support 80 provide a de current path between steel sheet 54 and counter electrode 66. The same electrochemical corrosion reaction that occurred between the steel products 14 and counter electrode 26 as described in reference to FIGS. 1 and 2 is also believed to occur between steel sheet 54 and counter electrode 66, and may therefore use the same weak acid or base electrolyte as used in the system of FIGS. 1 and 2.

With reference to both the embodiments of FIGS. 1 and 2 and FIGS. 5 and 6, the counter electrodes 26 or 66 may be formed in a slab-like or plate-like shape that partially line one or more inner walls of the tank 16 or 56. More than one counter electrode may be used if needed to achieve the desired surface area. The counter electrode 26 or 66 may be formed of such materials as graphite, HASTELLOY®) C-276, which is a nickel-chromium-molybdenum alloy, platinum, palladium, niobium-expanded mesh coated with platinum, such as DCX 125 (125 $\mu$-inch platinum over double-clad expanded niobium) (available commercially from Vincent Metals, Canonchet, R.I.), platinized titanium (titanium (expanded mesh or non-mesh) plated with platinum, then heat treated to diffuse/disperse the platinum onto and into the titanium). These materials all have an E° greater than the E° of steel. Graphite is relatively inexpensive and thus is preferred for use in the steel industry simply because it may be too cost prohibitive to line the immersion tanks with expensive materials like platinum. A portion of the counter electrode 26 or 66 could extend above the electrolyte level so that a dc coupling may be made to the steel without the dc coupling connection corroding during the pickling process.

As stated previously, regardless of the type of electrolyte, the acid or base concentration, or the temperature of the bath, an electrochemical cell is thought to be created, enhanced by the decoupling to the counter electrode without imposition of an external positive voltage from the electrode to the steel, whereby the mill scale layer is effectively stripped from the steel. Electrolyte 18 and 58 may be acidic or basic in nature. The pH of the acid bath is advantageously less than 4, more advantageously less than 3, and most advantageously between −1 and +2. The pH of the alkaline bath is advantageously greater than 8 or 9, and more advantageously greater than 10.3.

In one feature of the invention, electrolyte 18 or 58 is a dilute solution of acid or base in water. Advantageously, the acid or alkali content is less than 20% by volume, but may be up to 35%, and even up to 50%, if desired. By way of example, and not intended to limit the scope of the present invention, an electrolyte 18 or 58 may contain one or more of the following industrial acids or salts: hydrochloric acid, sulfuric acid, phosphoric acid, nitric acid, hydrochloric acid, and ferric chloride. For example, a weak acid comprising 12.5% by volume nitric acid and 5% by volume phosphoric acid may be used. The use of phosphoric acid is believed to enhance the evenness of the pickled surface, thereby reducing surface roughness. This may contribute to a yield improvement in the final steel product because less material is removed in the corrosion operation. Any Lewis acid is suitable for use in the present invention. Alternatively, electrolyte 18 or 58 may contain one or more alkalies, such as sodium hydroxide or ammonium phosphate.

There are thousands of ionic salt solutions, known to persons skilled in the art, that are suitable for use in the electrolyte of the present invention and are considered to be within the scope of the appended claims. It should be understood that newly developed and previously known electrolytes may be used in accordance with the invention. For example, sulfuric acid is typically selected for batch pickling of steel products due to its low cost, while hydrochloric acid is typically selected for continuous pickling of sheet steel because it is faster. These acids may be used in lower concentrations and at lower temperatures, however, than previously used, thus making the pickling process more environmentally friendly.

While not necessary, ammonium bifluoride, hydrazine, or a salt, such as sodium nitrate or sodium iodide, could be added to the electrolyte 18 or 58 to aid the necessary reaction for stripping the scale layer 12 or 52 from the steel product 14 or steel sheet 54, respectively. Peroxides, methanol, or isopropanol may also be added in small amounts. Any substance may be added to the electrolyte bath in accordance with the principles of the present invention to speed up the stripping reaction to cause more efficient stripping, or to achieve any other beneficial result.

In a further feature of the invention, the electrolyte bath may be operated at room temperature. Room temperature varies according to the environment, but it is typically between 55° F. and 105° F. (13° C.–41° C.). Advantageously, the bath is maintained at 90° F. (32° C.). Higher temperatures, preferably less than about 160° F. (72° C.), may also be used for speeding up the stripping process. This may be achieved by adding a heating coil, such as coil 42 of FIGS. 1 and 2 to heat the electrolyte bath. The higher the temperature, the faster the reaction proceeds, but this also creates an increase in the amount of fumes produced from the acid bath. Thus, a more environmentally friendly pickling process is achieved with lower temperatures, but with slower reaction rates. As stated previously with reference to FIG. 1, a device for agitating the electrolyte bath may also be added to speed up the pickling process. Additionally, it is preferred that the surface of the electrolyte bath be skimmed continuously or periodically to remove dirt, oil, dissolved oxide and the like so as to maintain a clean bath.

Figure 7:
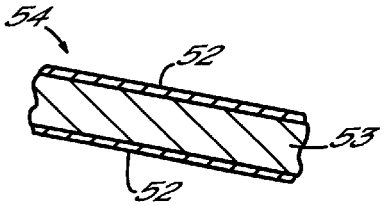
FIG. 7 is an enlarged view in cross-section of Area 7 of the steel strip in the system of FIG. 6.

In an alternative embodiment of the invention for increasing the surface area of the counter electrode, a counter electrode 88, as shown in FIG. 7, consists of a plastic canister 90 (approximately 55 gallons) containing broken graphite pieces 92 or granular graphite material (approximately 300 lbs. in a 55 gallon canister). This counter electrode 88 need not be contained within the tank 16, 56 and may be used in conjunction with or in lieu of counter electrodes 26, 66, discussed above. A graphite buss bar or cable 94 is connected at one end to the plastic canister 90 and at the other end to steel product 14 or sheet 54 or a conductive component in direct or indirect dc contact with the steel product or steel sheet, such as chain sling 22, bolster 24, scale breaker 60 or looping support 80. The acid in the electrolyte, which contains $Fe^{+2}$ and $Fe^{+3}$ ions from the dissolving oxide layers, may be sucked from tank 16 or 56 through tube 96 into the plastic canister 90 containing the graphite 92, and pumped back into the tank 16 or 56 through tube 98 by pump P to provide agitation to the electrolyte and to thus, effectively, immerse the graphite in the electrolyte by associating the electrolyte with the graphite. The same electrochemical reaction occurs to effectively strip the metal oxide scale layer as occurred in the embodiments of FIGS. 1, 2, 5 and 6. Thus, it may not be necessary to physically immerse a counter electrode in the electrolyte bath provided the electrolyte is brought into contact with a counter electrode material to, in effect, immerse the counter electrode. Similarly, although the above description details a system in which the steel is immersed in the electrolyte, the present invention contemplates the reverse system in which the electrolyte is brought into contact with the steel. Examples of other ways to associate the electrolyte with the steel include spraying or flooding the steel surface with the electrolyte.

EXAMPLES

A number of experiments were performed in a 100 mm×190 mm crystallization dish containing a slab of PVC plastic adapted to hold the samples and electrodes. Two different electrode materials were investigated in the following experiments, namely: (1) AFX-5Q, ⅛ inch thick milled graphite from POCO Graphite of Decatur, Tex.; and (2) DCX 125, platinum coated niobium expanded mesh from Vincent Metals, Canonchet, R.I. Five hundred milliliters of electrolyte was added in the crystal dish to cover about 1 inch in height of each sample. Comparative samples were not dc coupled to any electrode, while samples of the present invention were dc coupled to a counter electrode by means of a wire and alligator clips. Any other suitable means may be used in accordance with the principles of the present invention to provide an electrical path between the steel and the counter electrode. The crystal dish was placed on a temperature controlled, magnetic spinner hot plate set at 350 RPM for agitation and temperature adjustment. The electrolyte comprised an acid or alkali and deionized water. The average sample weighed about 100 g, and was about 2 inches wide, 3–4 inches long and between about 0.075 inch and 0.180 inch thick. Each sample was immersed two times, once at one end and once at the opposite end until complete or nearly complete stripping was obtained.

The following discussion places emphasis on the mean results of the various tests. This is believed to take into account the various experimental errors introduced into the system.

The results are provided in terms of average weight loss, as an approximation of the efficiency of the system in stripping the oxide. The surface area of each side of the samples varies from one side to the other and from one sample to the next. Furthermore, thickness of the scale layer varies along the sample. Thus, statistical averages and general trends are examined to determine the efficiency of the present invention over processes that do not use a counter electrode. In some samples, complete or nearly complete stripping was achieved and a smooth surface obtained, and in other samples pitting occurred. It is believed, however, that the results obtained demonstrate that the pickling system of the present invention is more efficient than the pickling system of the prior art.

Test Set 1

Eight experiments were run as described above using a graphite electrode dc coupled to one side of the steel sample, the electrode and sample immersed in an electrolyte containing 20–35% by volume $HSO_4$. Sulfuric acid is typically used in steel plants for batch pickling processes. No electrode was coupled to the other side of the sample during its immersion. The temperature of the bath varied for the eight samples, but was in the range of about 26–72° C. In this test set, the samples were put into a bench vise and crimped to simulate the scale breaking function that occurs in continuous pickling of sheet steel. The weight loss for each side of the sample was measured periodically until complete or nearly complete removal of the oxide scale, and the total weight loss calculated. The total weight loss for stripping with an electrode was divided by the total weight loss for stripping without an electrode to obtain an approximation of the percent improvement of the stripping process by use of an electrode. For the eight samples decoupled to the graphite electrode, the average total weight loss was 0.3913, while the average total weight loss for the same samples pickled without an electrode was 0.3431. Thus, the electrode pickling system of the present invention displayed, on average, a 14% improvement in pickling efficiency. Furthermore, in general, it was observed that complete stripping of the metal oxide scale layer occurred faster with the graphite electrode than without the electrode.

Test Set 2

Three experiments were run as described above using a platinum electrode dc coupled to one side of the steel sample, the electrode and sample immersed in an electrolyte containing 20% by volume $H_2SO_4$. Again, no electrode was coupled to the other side of the sample during its immersion. The temperature of the bath was similar for each of the three samples, ranging from about 44–48° C. Also in this test set, the samples were put into the bench vise and crimped to simulate the scale breaking function. The weight loss for each side of the sample was measured periodically until complete or nearly complete removal of the oxide scale, and the total weight loss calculated. For the three samples decoupled to the platinum electrode, the average total weight loss was 0.4646, while the average total weight loss for the same samples pickled without an electrode was 0.3059. Thus, the electrode pickling system of the present invention displayed, on average, a 51.9% improvement in pickling efficiency. Just as with the graphite electrodes, it was observed that, on average, the use of a platinum electrode achieves faster stripping than without an electrode. It also appeared that platinum electrodes work faster than graphite electrodes. As discussed previously, however, it would be very cost prohibitive to line an immense steel pickling tank with platinum. Thus, despite the apparent longer stripping time, graphite is preferred as an electrode material.

Test Set 3

Eight experiments were run as described above using a graphite electrode de coupled to one side of the steel sample, the electrode and sample immersed in an electrolyte containing 10% by volume $H_2SO_4$. Again, no electrode was coupled to the other side of the sample during its immersion. The temperature of the bath varied for the eight samples, but was in the range of about 42–63° C. In this test set, the samples were not crimped. The weight loss for each side of the sample was measured periodically until complete or nearly complete removal of the oxide scale, and the total weight loss calculated. For the eight samples decoupled to the graphite electrode, the average total weight loss was 0.1919, while the average total weight loss for the same samples pickled without an electrode was 0.18375. Thus, the electrode pickling system of the present invention displayed, on average, a 4.4% improvement in pickling efficiency.

Test Set 4

Five experiments were run as described above using a graphite electrode dc coupled to one side of the steel sample, the electrode and sample immersed in an electrolyte containing 10% by volume HCI. Hydrochloric acid is typically used for the continuous pickling of sheet steel. Again, no electrode was coupled to the other side of the sample during its immersion. The temperature of the bath varied for the five samples, but was in the range of 44–53° C. In this test set, the samples were not crimped. The weight loss for each side of the sample was measured periodically until complete or nearly complete removal of the oxide scale, and the total weight loss calculated. For the five samples decoupled to the graphite electrode, the average total weight loss was 0.1117, while the average total weight loss for the same samples pickled without an electrode was 0.10294. Thus, the electrode pickling system of the present invention displayed, on average, a 8.5% improvement in pickling efficiency.

Test Set 5

Three experiments were run as described above using a graphite electrode dc coupled to one side of the steel sample, the electrode and sample immersed in an electrolyte containing 8.5% by volume phosphoric acid and 5% by volume nitric acid. For one of the experiments, 30 mL HBr and 15 mL $HNO_3$ was also added to the electrolyte. Again, no electrode was coupled to the other side of the sample during its immersion. A fourth sample was also tested on one side without the electrode. The temperature of the bath varied for the samples, but was in the range of about 26–47° C. In this test set, the samples were put into the bench vise and crimped to simulate the scale breaking function. The weight loss for each side of the sample was measured periodically until complete or nearly complete removal of the oxide scale, and the total weight loss calculated. For the three samples dc coupled to the graphite electrode, the average total weight loss was 0.747, while the average total weight loss for the four samples pickled without an electrode was 0.363. Thus, the electrode pickling system of the present invention displayed, on average, a 106% improvement in pickling efficiency. It has thus been demonstrated that efficient pickling may be achieved with the use of a phosphoric/nitric acid solution as a substitute for the conventional sulfuric and hydrochloric acid solutions.

Several experiments were also conducted in which an external power source 44 was placed in the dc circuit, with the positive cathode 46 dc coupled to the steel sample 14 and the negative anode 48 dc coupled to the graphite electrode 26 as in the case of FIG. 4. A voltage of 3.27 volts was applied and allowed to float. Using a 2 Molar sodium bicarbonate electrolyte, it was demonstrated that the stripping rate may be increased with an increase in current and voltage supplied by an external power source. The external power source 44 was also used to pickle a sample in a 12.5% by volume nitric acid—5% by volume phosphoric acid solution, and the fastest rate of all the experiments conducted was observed.

The experimentation conducted demonstrated that, on average, faster stripping may be achieved by the system of the present invention, irrespective of the particular acids used. It was observed, however, that a nitric/phosphoric acid solution produced the fastest pickling operation of the electrolytes tested. Pitting of the steel may occur if left in the pickling bath too long, but the majority of samples achieved complete stripping without a corrosive attack of the steel surface. In general, it was observed that the surfaces from the galvanically, passive stripping of the present invention appeared smoother than the surfaces pickled without a counter electrode. It was also demonstrated that stripping may be achieved at acceptable rates using lower temperatures and acid concentrations. If desired, however, temperature or acid content may be increased, or an external power source may be added in the negative sense, to achieve even faster stripping times.

In use, steel products or sheet are immersed into an electrolyte bath in a tank having a counter electrode of higher E° than the steel, and the steel is dc coupled to the counter electrode without imposition of an external positive voltage from the electrode to the steel, whereby metal oxide scale in the mill scale layer present on the steel surface is dissolved into the electrolyte bath. By virtue of the foregoing, a process and system are provided for the efficient and complete removal of metal oxide scale from steel products and sheet by an electrochemical reaction.

While the above detailed description focused on the principles of the present invention as they apply to steel and iron oxide scale, it is to be understood that the principles of the present invention extend to other metals and alloys and their respective oxide scales. In use, a metal (or alloy) product is immersed into an electrolyte, or otherwise associated with an electrolyte, and the electrolyte is immersing or otherwise associated with a counter electrode of E° higher than the E° of the metal (or alloy), and the metal (or alloy) product is dc coupled to the counter electrode without imposition of an external positive voltage from the electrode to the metal (or alloy), whereby metal oxide scale present on the metal (or alloy) surface is dissolved into the electrolyte bath. By virtue of the foregoing, a process and system are provided for the efficient and complete removal of metal oxide scales from virtually any metal product by an electrochemical reaction.

While the present invention has been illustrated by the description of embodiments thereof, and while the embodiments have been described in considerable detail, they are not intended to restrict or in any way limit the scope of the appended claims to such detail. Additional advantages and modifications will readily appear to those skilled in the art. For example, while room temperature stripping baths are desirable for environmental and safety reasons, medium to high temperature acid baths may be used for stripping scale from steel sheets and products to obtain complete removal of the iron oxide layer in a short length of time. Also, the electrolyte may be an alkali bath instead of an acid bath. Further more, although metal oxide scale on steel was focused upon in the foregoing description, other metal-base products, such as stainless steel, aluminum, zirconium, zinc, copper and alloys thereof on which surface oxide scale forms may be pickled by the process and system of the present invention. The invention in its broader aspects is, therefore, not limited to the specific details, representative apparatus and method and illustrative examples shown and described. Accordingly, departures may be made from such details without departing from the scope or spirit of applicant's general inventive concept.

What is claimed is:

1. A system for stripping a metal oxide scale from a metal surface, the system comprising:

a metal product having an oxide scale layer on a surface of the metal product, the metal product having a first natural E°;

a separate counter electrode having a second natural E° greater than the first E°;

a holder for the metal product having a third natural E° greater than the first E°, the holder formed to suspend the metal product and to provide a current path therebetween;

an electrical conductor electrically connecting the counter electrode to the holder whereby to provide a dc current path therebetween without imposition of an external positive voltage from the counter electrode to the metal; and an electrolyte in association with the metal product and counter electrode to thereby strip the oxide scale layer from the surface of the metal product.

2. The system of claim 1, wherein the metal product comprises a bundle of individual steel products, each steel product having the oxide scale layer thereon, and each steel product having the first natural E°.

3. The system of claim 2, wherein the holder suspending the metal product is adapted to immerse the metal product in the eletrolyte whereby to strip the oxide scale layer from the steel products.

4. The system of claim 1, further including an external power source coupled in a negative sense from the counter electrode to the holder.

5. A system for stripping a metal oxide from a metal surface the system comprising:

a metal product having an oxide scale layer on a surface of the metal product, the metal product having a first natural E°;

a separate counter electrode having a second natural E° greater than the first E°;

a device for suspending the metal product in a tank;

one or more bolsters in the tank supporting the metal product and providing a current path therebetween, the bolster having a third natural E° greater than the first E°;

an electrical conductor electrically connecting the counter electrode to the bolster whereby to provide a dc current path therebetween without imposition of an external positive voltage from the counter electrode to the metal; and an electrolyte in association with the metal product and counter electrode to thereby strip the oxide scale layer from the surface of the metal product.

6. A process for stripping metal oxide scale from metal products, comprising:

dc coupling a metal product to a counter electrode without imposing an external positive voltage from the counter electrode to the metal product, wherein the metal product has an oxide scale layer, and wherein the natural E° of the counter electrode is greater than the natural E° of the metal product;

providing an electrolyte having a substantially non-neutral pH; and associating the dc coupled metal product and the counter electrode with the electrolyte for a time sufficient to strip the oxide scale from the metal product.

7. The process of claim 6, wherein the metal product is sheet steel, and the sheet steel is passed through and immersed in the electrolyte in a continuous feed line for a time sufficient to strip the oxide scale from the sheet steel.

8. The process of claim 6, wherein the metal product is bar stock steel, and the bar stock steel is suspended and immersed in the electrolyte for a time sufficient to strip the oxide scale from the bar stock steel.

9. The process of claim 6, wherein a counter electrode is provided comprising a material selected from the group consisting of: graphite, nickel-base alloys, nickel-chromium-molybdenum alloys, platinum, platinized titanium, niobium expanded mesh coated with platinum, and palladium.

10. The process of claim 6, further comprising maintaining the electrolyte at a temperature of between about 55° F. and 160° F.

11. The process of claim 6, wherein an electrolyte of pH less than 4 is provided.

12. The process of claim 6, wherein an electrolyte of pH between −1 and +2 is provided.

13. The process of claim 6, wherein an electrolyte of pH greater than 9 is provided.

14. The process of claim 6, wherein an electrolyte of pH greater than 10.2 is provided.

15. The process of claim 6, wherein the electrolyte includes a Lewis acid.

16. The process of claim 6, wherein the electrolyte includes a first substance comprising one or more chemicals selected from the group consisting of: hydrochloric acid, sulfuric acid, phosphoric acid, nitric acid, hydrofluoric acid, ferric chloride, sodium hydroxide and ammonium phosphate.

17. The process of claim 16, wherein the electrolyte includes the first substance in an amount less than about 50% by volume.

18. The process of claim 16, wherein the electrolyte includes the first substance in an amount less than about 35% by volume.

19. The process of claim 16, wherein the electrolyte includes the first substance in an amount less than about 20% by volume.

20. The process of claim 16, wherein an electrolyte further includes a second substance comprising one or more chemicals selected from the group consisting of: ammonium bifluoride, hydrazine, sodium nitrate, sodium iodide, methanol, isopropanol and peroxide.

21. The process of claim 6 further comprising connecting an external dc power source in the negative sense from the counter electrode to the metal product.

22. The process of claim 21, wherein the dc coupling is through the power source.

23. The process of claim 6, further comprising providing a tank having an inner wall, at least partially lining the inner wall with the counter electrode, providing the electrolyte in the tank, and immersing the metal product in the electrolyte in the tank.

24. The process of claim 6, further comprising operatively coupling an agitator to the electrolyte to agitate the electrolyte during stripping of the oxide scale.

25. The process of claim 24, further comprising stirring the electrolyte during stripping of the oxide scale.

26. The process of claim 6, further comprising connecting a conductive wire to the metal product and the counter electrode to provide the dc coupling.

27. The process of claim 6, further including passing the metal product though a pair of rollers prior to association with the electrolyte, whereby the mill scale layer is cracked.

28. The process of claim 6, further comprising providing a canister, placing the counter electrode in the canister, and fluidically coupling the counter electrode to the electrolyte.

29. A process for stripping iron oxide scale from continuous sheet steel, including:

providing at least one tank having means for passing a steel sheet having an iron oxide scale layer through in continuous fashion;

continuously moving the steel sheet through the tank, the sheet having a first natural E°;

providing a separate counter electrode in the tank having a second natural E° greater than the first E°;

providing an electrolyte having a substantially non-neutral pH in the tank containing the sheet and counter electrode; and electrically connecting the counter electrode to a component in direct contact with the moving sheet whereby to provide a dc current path therebetween without imposition of an external positive voltage from the counter electrode to the sheet, and whereby to strip the iron oxide scale layer from the sheet.

30. The process of claim 29, wherein providing the counter electrode includes selecting a material from the group consisting of: graphite, nickel-base alloys, nickel-chromium-molybdenum alloys, platinum, platinized titanium, niobium expanded mesh coated with platinum, and palladium.

31. The process of claim 29, further including providing a pair of rollers through which the sheet passes prior to entering the tanks, whereby the iron oxide scale layer is cracked.

32. The process of claim 31, wherein the counter electrode is electrically connected to the rollers.

33. The process of claim 29, further including agitating the electrolyte while the steel sheet is moving through the tank.

34. The process of claim 29, further including coupling an external power source in a negative sense from the counter electrode to the component in direct contact with the sheet.

* * * * *

UNITED STATES PATENT AND TRADEMARK OFFICE

CERTIFICATE OF CORRECTION

PATENT NO. : 6,294,072 B1
DATED : September 25, 2001
INVENTOR(S) : David C. Fairbourn It is certified that error appears in the above-identified patent and that said Letters Patent is hereby corrected as shown below:

Column 3,
Line 45, please delete "hightemperature" and replace with -- high-temperature --;

Column 5,
Line 23, please delete "iron iron" and replace with -- iron ion --;

Column 6,
Line 39, please delete "arc" and replace with -- are --;

Column 8,
Line 35, please delete "de current" and replace with -- dc current --;
Line 49, please delete "HASTELLOY ®)" and replace with -- HASTELLOY ® --;

Column 11,
Line 20, please delete "$HSO_4$" and replace with -- $H_2SO_4$ --;
Lines 34 and 58, please delete "decoupled" and replace with -- dc coupled --;

Column 12,
Lines 8, 17 and 36, please delete "decoupled" and replace with -- dc coupled --;
Line 28, please delete "HCI" and replace with -- HCl --;

Column 14,
Line 3, please delete "Further more," and replace with -- Furthermore, --.

Signed and Sealed this

Twenty-eighth Day of May, 2002

*Attest:*

*Attesting Officer*

JAMES E. ROGAN
*Director of the United States Patent and Trademark Office*